United States Patent [19]

Watson

[11] 3,930,650

[45] Jan. 6, 1976

[54] THROWING DEVICE

[75] Inventor: William Watson, Wolfeboro, N.H.

[73] Assignee: Molded Foam Industries, Inc., Franklin, N.H.

[22] Filed: Dec. 23, 1974

[21] Appl. No.: 535,722

[52] U.S. Cl.... 273/106 R; 273/DIG. 8; D34/15 EE; 273/58 J; 273/58 R

[51] Int. Cl.[2]..... A63B 65/00

[58] Field of Search..... 273/DIG. 8, 58 R, 58 J, 273/95 R, 106 R, 106 B, 128; D34/15 EE; 35/72; 46/74 D

[56] References Cited

UNITED STATES PATENTS

| | | | |
|---|---|---|---|
| 334,848 | 1/1886 | Damm | 273/105.4 |
| 890,920 | 6/1908 | Newbold | D34/15 EE |
| 1,539,977 | 6/1925 | Verschoyle | 273/106 R |
| 3,359,678 | 12/1967 | Headrick | 273/106 A |
| 3,613,295 | 10/1971 | Everett | 273/106 A |
| 3,673,732 | 7/1972 | Liotta | 46/74 D |
| 3,675,926 | 7/1972 | Misevich | 273/105.4 |
| 3,712,627 | 1/1973 | Stroud | 273/128 A |
| 3,758,985 | 9/1973 | Heisler | 46/74 D |
| 3,761,087 | 9/1973 | Meyer | 273/DIG. 8 |
| 3,852,910 | 12/1974 | Everett | 273/106 R |

*Primary Examiner*—Paul E. Shapiro
*Assistant Examiner*—Marvin Siskind
*Attorney, Agent, or Firm*—Kenway & Jenney

[57] ABSTRACT

A throwing device made of a light weight, resilient foam material, such as urethane, having a generally hemispheroidal shape with a rounded base. The throwing device has an outer surface formed of major and minor surfaces which have a common axis of symmetry and are convex relative to a plane perpendicular to the common axis. The major and minor sub-surfaces each have an extremal point along the axis with the major sub-surface point being farther from the plane than the minor sub-surface point. The major sub-surface is a segment of a substantially spherical segment.

13 Claims, 5 Drawing Figures

THROWING DEVICE

BACKGROUND OF THE INVENTION

This invention relates generally to toys and amusement apparati and, more particularly, to throwing devices.

A succession of relatively rigid saucer-like throwing devices have been developed and marketed in recent years for use as amusement apparati. In use, these devices are simultaneously imparted with a rotational velocity about a principal axis and a translational velocity in a direction perpendicular to the principal axis. A principal disadvantage of these devices lies in their construction material, which is relatively rigid, for example, polyethylene. As a result, the use of such devices is primarily restricted to be outdoors in order to reduce the likelihood of collision with fragile items during flight.

It is an object of the present invention to provide a throwing device which may be used indoors with minimal danger of damage to fragile items.

Is is a further object to provide a throwing device which may be launched in a controlled manner to provide a predetermined trajectory.

Other and more specific objects of invention will become apparent from the description and the figures which follow.

SUMMARY OF THE INVENTION

A throwing device in accordance with the present invention is composed of a resilient foam material and has an outer surface comprising two sub-surfaces. Each sub-surface is symmetrical about a common axis of symmetry, and is convex relative to a reference plane perpendicular to the common axis and passing between the two sub-surfaces. Accordingly, each sub-surface includes an extremal point which lies along the axis of symmetry. When the device is thrown so that it rotates about its axis of symmetry and translates in a direction substantially perpendicular to that axis, the device follows a trajectory which tends to curve in the direction of the common axis to the side of the sub-surface having an extremal point which is farthest from the reference plane.

For a better understanding of the present invention, together with other features and advantages of the invention, reference should be made to the following detailed description of preferred embodiments which should be read in connection with the appended drawings, and in which.

DESCRIPTION OF THE PREFERRED EMBODIMENT

Figure 1:
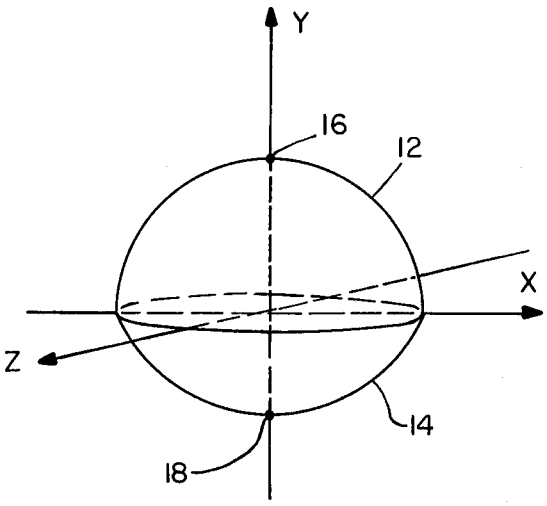
FIG. 1 shows an embodiment of the present invention in relation to an XYZ coordinate system.

FIG. 1 shows an embodiment of the present invention having a generally hemispheroidal shape with a rounded base. The presently-described throwing device 10 is constructed of a light weight resilient foam, such as urethane. Other resilient foam materials may be utilized in alternative embodiments. The outer surface of device 10 is non-porous to permit smooth airflow thereby.

In FIG. 1, device 10 is shown with respect to an XYZ coordinate system, wherein the Y axis is a common axis of symmetry for a major sub-surface 12 and a minor sub-surface 14 of the embodiment. As shown, sub-surfaces 12 and 14 are also convex relative to the X-Z reference plane which passes between sub-surfaces 12 and 14. As a result of the convex nature of sub-surfaces 12 and 14, each has an extremal point (point 16 for subsurface 12 and point 18 for sub-surface 14) which is located along the axis of symmetry. The major sub-surface 14 is so denoted because its extremal point 16 is farther from the X-Z plane than is the extremal point 18 of minor sub-surface 14.

For the present embodiment, sub-surfaces 12 and 14 are segments of spherical surfaces having different radii of curvature. The major sub-surface radius of curvature may lie in the range of 2–6 inches and the minor sub-surface radius of curvature may lie in the range of 3–12 inches. The ratio of the major-to-minor radius of curvature in the present invention lies in the range of 1/1.25 to 1/4.0 and preferably that ratio is 1/1.75. For the best known embodiment, the major and minor radii of curvature are 2 and 3¾ inches, respectively, with the respective centers of curvature being separated by 2¼ inches.

Figure 2:
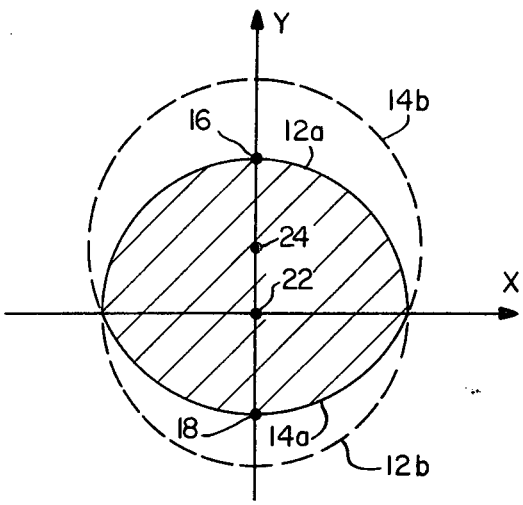
FIG. 2 shows a cross-section of the embodiment of FIG. 1 in the X-Y plane, together with a cross-section of the spherical surfaces in that plane which define the outer surface of the embodiment.

It will be understood that the solid angle circumscribed by the major sub-surface about its center of curvature exceeds the solid angle circumscribed by the minor sub-surface about its center of curvature for the embodiment of FIG. 1. In other embodiments, this relationship may be reversed. FIG. 2 shows a cross-section of the embodiment of FIG. 1 taken along the X-Y reference plane. In FIG. 2 and all subsequent figures, the elements corresponding to similar elements of FIG. 1 are denoted with identical reference numerals.

In FIG. 2, the solid arc segment **12*a* of the smaller circle represents the intersection of the X-Y plane with the smaller spherical surface which forms the major sub-surface 12. The dashed arc segment 12*b* of that smaller circle represents the remainder of the intersection of the spherical surface with the X-Y plane. The center of curvature point 22** for the smaller spherical surface is located at the intersection of the X and Y axes.

The solid arc segment **14*a* of the larger circle arc represents the intersection of the X-Y plane with the larger spherical surface which forms the minor sub-surface 14. The dashed arc segment 14*b* of that larger circle represents the remainder of the intersection of the larger spherical surface with the X-Y plane. The point 24 is representative of the center of curvature of the larger spherical surface and lies on the Y axis above the X axis. It will be understood that the embodiment shown in FIGS. 1 and 2, the centers of curvature of the major and minor sub-surfaces lie in the interior region of the throwing device 10.**

Figure 3:
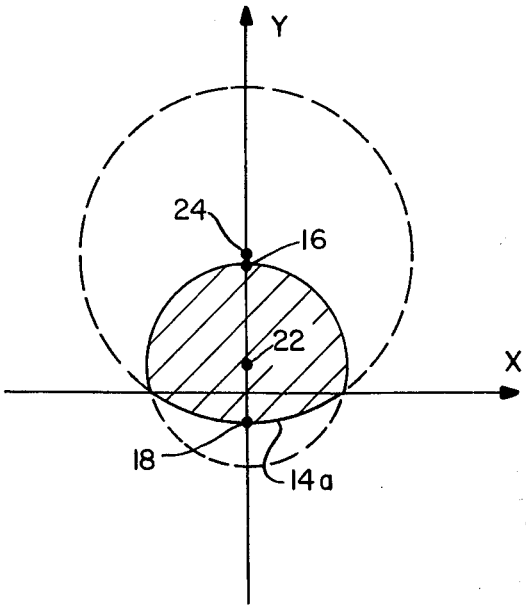
FIGS. 3–5 similarly show cross-sections of alternative embodiments of the present invention.
Figure 4:
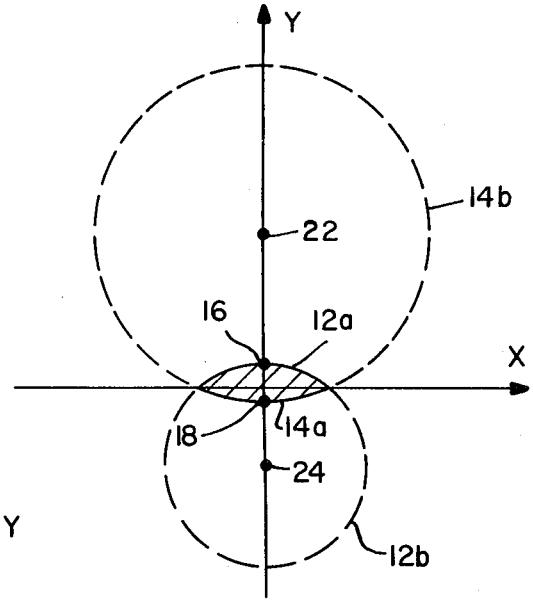

Other embodiments of the present invention may be formed by repositioning the relative locations of the spherical surfaces which define the outer surface of the throwing device. For example, FIG. 3 shows a cross-section of an embodiment along the X-Y plane wherein the center of curvature 22 of the major sub-surface 12 is located on the interior of device 10 but the center of curvature 24 of the minor sub-surface 14 is outside device 10. In the embodiment of FIG. 4, both centers of curvature 22 and 24 are outside device 10. In all embodiments shown in FIGS. 1-4, the solid angle circumscribed by the major (smaller) radius sub-surface about its center of curvature exceeds the solid angle circumscribed by the minor (larger) radius sub-surface about its center of curvature.

Figure 5:
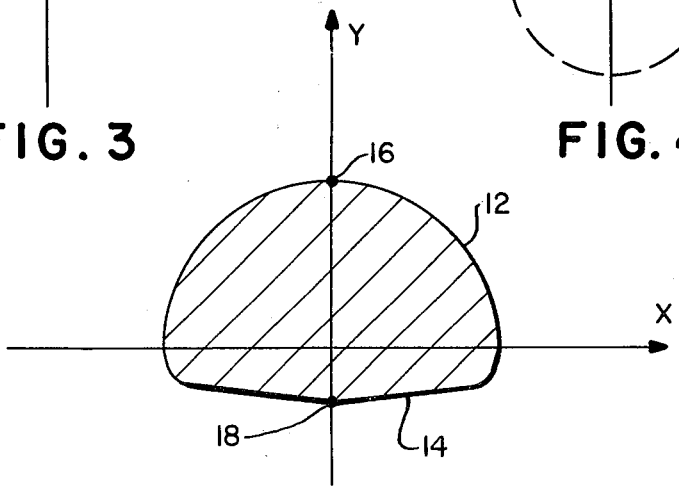

In the embodiment of FIG. 5, the corresponding major sub-surface 12 is hemispherical, and the corresponding minor sub-surface 14 is merely convex and but not a spherical segment. In other embodiments, sub-surface 12 is not necessarily a spherical segment, although it is convex relative to the X-Z plane.

In still other embodiments, the major and minor sub-surfaces 12 and 14 for any of the above-described embodiments may be mutually joined by a surface (symmetrical about the Y axis) which joins the surfaces 12 and 14 in a smooth manner.

In use, the throwing of device 10 with an imparted rotational velocity about the Y axis and with a lateral velocity in the X-Z plane results in a trajectory which tends to curve toward the major sub-surface extremal point 16 along the Y axis. For example, if thrown with the Y axis horizontal and extremal point 16 lying to the right of the X-Z plane, the throwing device will curve to the right (while, of course, simultaneously obeying the laws of gravity with respect to vertical motion). On the other hand, if thrown with the Y axis horizontal with the extremal point to the left of the X-Z plane, the device 10 will tend to curve to the left. Similarly, with the Y axis vertical, depending on whether the extremal point 16 is above or below the X-Z plane, the device 10 will tend to offset or add to the effect of gravity, respectively, and correspondingly, to float or dip in its trajectory.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A throwing device composed of a resilient foam material and having an outer surface comprised of a major and minor sub-surface, each of said sub-surfaces being symmetrical about a common axis of symmetry and being convex relative to a plane which is perpendicular to said common axis and between said sub-surfaces, said major and minor sub-surfaces each having an extremal point along said common axis, said major sub-surface extremal point being farther from said plane than said minor sub-surface extremal point, and wherein said major sub-surface is a segment of a substantially spherical surface

2. A throwing device according to claim 1 wherein said minor sub-surface is a segment of a substantially spherical surface, said spherical surfaces having differing radii of curvature.

3. A throwing device according to claim 2 wherein the solid angle circumscribed by the smaller radius sub-surface about its center of curvature exceeds the solid angle circumscribed by the larger radius sub-surface about its center of curvature.

4. A throwing device according to claim 3 wherein the centers of curvature of both of said spherical surfaces lie within the interior region of at least one of said spherical surfaces.

5. A throwing device according to claim 4 wherein one of said surfaces has radius of curvature in the range 2–6 inches and the other has radius of curvature in the range 3–12 inches.

6. A throwing device according to claim 5 wherein said segments are mutually joined by a smooth surface, said smooth surface being symmetrical about said common axis.

7. A throwing device according to claim 4 wherein the ratio of said radii of curvature is in the range 1/1.25 to 1/4.0.

8. A throwing device according to claim 7 wherein said segments are mutually joined by a smooth surface, said smooth surface being symmetrical about said common axis.

9. A throwing device according to claim 2 wherein one of said surfaces has radius of curvature in the range 2–6 inches and the other has radius of curvature in the range 3–12 inches.

10. A throwing device according to claim 2 wherein the ratio of said radii of curvature is in the range 1/1.25 to 1/4.0.

11. A throwing device according to claim 2 wherein said segments are mutually joined by a smooth surface, said smooth surface being symmetrical about said common axis.

12. A throwing device according to claim 1 wherein said outer surface is smooth and non-porous.

13. A throwing device according to claim 1 wherein said resilient foam material is urethane.

* * * * *